US010694778B2

(12) United States Patent
Besso et al.

(10) Patent No.: US 10,694,778 B2
(45) Date of Patent: Jun. 30, 2020

(54) SMOKING ARTICLE WITH LIQUID DELIVERY MATERIAL

(71) Applicant: PHILIP MORRIS PRODUCTS S.A., Neuchatel (CH)

(72) Inventors: Clement Besso, Neuchatel (CH); Laurent Lavanant, Evian-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 359 days.

(21) Appl. No.: 15/102,887

(22) PCT Filed: Dec. 18, 2014

(86) PCT No.: PCT/EP2014/078589
§ 371 (c)(1),
(2) Date: Jun. 9, 2016

(87) PCT Pub. No.: WO2015/101512
PCT Pub. Date: Jul. 9, 2015

(65) Prior Publication Data

US 2016/0295910 A1 Oct. 13, 2016

(30) Foreign Application Priority Data

Dec. 31, 2013 (EP) ..... 13199916

(51) Int. Cl.
*A24D 3/06* (2006.01)
*A24B 15/28* (2006.01)
(Continued)

(52) U.S. Cl.
CPC ..... *A24D 3/061* (2013.01); *A24B 15/281* (2013.01); *A24B 15/283* (2013.01); *A24B 15/303* (2013.01); *A24D 1/002* (2013.01)

(58) Field of Classification Search
None
See application file for complete search history.

(56) References Cited

U.S. PATENT DOCUMENTS 6,274,162 B1 8/2001 Steffenino
6,793,949 B2 9/2004 Panesar
(Continued)

FOREIGN PATENT DOCUMENTS

CN 1091900 A 1/2001
CN 1422539 A 6/2003
(Continued)

OTHER PUBLICATIONS

"Introduction to Alginate—Structure", CyberColloids, LTD., no date,[online], retrieved from the Internet, [retrieved Jan. 23, 2019, <URL: http://www.cybercolloids.net/information/technical-articles/introduction-alginate-structure>. (Year: 2019).*
(Continued)

*Primary Examiner* — Dennis R Cordray
(74) *Attorney, Agent, or Firm* — Mueting Raasch Group

(57) ABSTRACT

A smoking article (10) incorporates a liquid release component of a sustained release liquid delivery material (20), the liquid delivery material comprising a closed matrix structure having a polymer matrix defining a plurality of domains. A liquid composition is trapped within the domains and is releasable from the closed matrix structure upon compression of the liquid release component. The polymer matrix is formed of one or more anionic polysaccharides cross-linked by multivalent cations. A filler comprising one or more amphiphilic polysaccharides is incorporated within the polymer matrix. The one or more amphiphilic polysaccharides of the filler are selected from starch chemically modified to be amphiphilic and starch derivatives chemically modified to be amphiphilic.

19 Claims, 1 Drawing Sheet

(51) Int. Cl.
*A24B 15/30* (2006.01)
*A24D 1/00* (2020.01)

(56) References Cited

U.S. PATENT DOCUMENTS

| | | | | |
|---|---|---|---|---|
| 6,929,814 | B2 | 8/2005 | Bouwmeesters | |
| 7,878,962 | B2 | 1/2011 | Karles | |
| 8,459,272 | B2 | 6/2013 | Karles | |
| 8,747,562 | B2 | 6/2014 | Mishra | |
| 8,820,331 | B2 | 9/2014 | Hartmann | |
| 2006/0014412 | A1 | 1/2006 | Lutsch | |
| 2008/0142028 | A1* | 6/2008 | Fagg | A24D 3/061 131/361 |
| 2008/0171083 | A1 | 7/2008 | Staniforth | |
| 2011/0083680 | A1* | 4/2011 | Mishra | A24B 15/283 131/275 |
| 2011/0120481 | A1 | 5/2011 | Besso | |

FOREIGN PATENT DOCUMENTS

| | | | |
|---|---|---|---|
| CN | 103451019 | A | 12/2013 |
| EA | 012456 | B1 | 10/2009 |
| JP | 4-75578 | | 3/1992 |
| JP | 2001-507926 | | 6/2001 |
| JP | 2007-532620 | | 11/2007 |
| JP | 2008-546400 | | 12/2008 |
| JP | 2013-507109 | | 3/2013 |
| KZ | 25499 | B | 2/2012 |
| KZ | 27534 | B | 10/2013 |
| WO | WO 2008/121610 | | 10/2008 |
| WO | WO 2009/022232 | | 2/2009 |
| WO | WO 2010/107613 | | 9/2010 |
| WO | WO 2012/156699 | | 11/2012 |
| WO | WO 2013/068304 | | 5/2013 |

OTHER PUBLICATIONS

Office Action issued in Japan for Application No. 2016-539120 dated Nov. 1, 2018 (10 pages). English translation included.
Office Action issued in Kazakhstan for Application No. 2016/0656.1 dated Oct. 11, 2017 (9 pages). English translation included.
European Extended Search Report for Application No. 131999161.1-1357 dated May 19, 2014 (6 pages).
PCT Search Report and Written Opinion for PCT/EP2014/078589 dated Feb. 13, 2015 (7 pages).
Office Action issued in China for Application No. 201480067889.3 dated Dec. 4, 2018 (21 pages). English translation included.
"Grain Dictionary", Editorial Board of Grain Dictionary, p. 562, China Materials Publishing House.
Li Hongliang et al., "Safety and Application of Food Additives", p. 284, Chemical Industry Press.
Belitz et al., "Food Chemistry", p. 242, China Agricultural University Press.
Office Action issued in China for Application No. 201480067889.3 dated May 8, 2019 (22 pages). English translation included.
Wu Kegang et al., "Food Microcapsule Technology", China Light Industry Press, pp. 86-88.
Office Action issued in Japan for Application No. 2016-539120 dated Jun. 27, 2019 (10 pages). English translation included.
Office Action issued in China for Application No. 201480067889.3 dated Mar. 12, 2020 (5 pages).

* cited by examiner

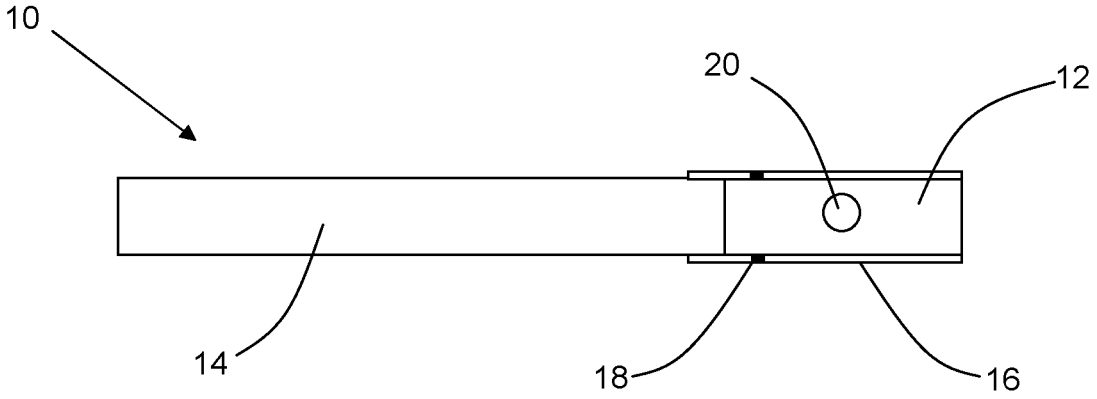
10
20
12
14
18
16

SMOKING ARTICLE WITH LIQUID DELIVERY MATERIAL

This application is a U.S. National Stage Application of International Application No. PCT/EP2014/078589, filed Dec. 18, 2014, which was published in English on Jul. 9, 2015, as International Patent Publication WO 2015/101512 A1. International Application No. PCT/EP2014/078589 claims priority to European Application No. 13199916.1 filed Dec. 31, 2013.

The present invention relates to a liquid delivery material that provides sustained release of a liquid upon compression of the material, and to a smoking article incorporating such a liquid delivery material.

It is well known to incorporate flavourant additives into smoking articles in order to provide additional flavours to the consumer during smoking. Flavourants may be used to enhance the tobacco flavours produced upon heating or combusting the tobacco material within the smoking article, or to provide additional non-tobacco flavours such as mint or menthol.

The flavourant additives used in smoking articles, such as menthol, are commonly in the form of a liquid flavourant which is incorporated into the filter or the tobacco rod of the smoking article using a suitable liquid carrier. Liquid flavourants are often volatile and will therefore tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. Where such capsules are crushed to release the flavourant, the capsules break open at a particular force and release all of the flavourant at that force.

It has also been previously proposed to encapsulate a flavourant within a matrix material, wherein compression is applied to the matrix material in order to release the flavourant. The encapsulated flavourant may be released more gradually than with a capsule. Unlike with the encapsulating structure of a capsule, the matrix structure does not break open to release all of the flavourant at a particular force but is gradually broken down as the force is sustained. In some cases, this type of release provides little or no indication to the consumer that the flavourant has been released from the matrix material.

It is also known to incorporate other types of non-flavourant liquid additives into smoking articles in order to adapt the smoke in some way during smoking. For example, certain liquid additives may be provided within a smoking article filter to alter the filtration properties of the filter during smoking.

It would be desirable to provide an improved liquid delivery material for a smoking article that provides an indication to the consumer that the liquid has been released from the material. It would be particularly desirable to provide such a material that shows improved stability and improved retention of liquid additives during storage.

According to the invention there is provided a smoking article incorporating at least one liquid release component formed of a sustained-release liquid delivery material, the liquid delivery material comprising a closed matrix structure defining a plurality of domains. The closed matrix structure comprises a polymer matrix defining a plurality of domains. The polymer matrix is formed of one or more anionic polysaccharides cross-linked by multivalent cations. The closed matrix structure further comprises a filler within the polymer matrix. The filler comprises one or more amphiphilic polysaccharides. A liquid composition is trapped within the domains of the polymer matrix and is releasable from the closed matrix structure upon compression of the liquid release component.

According to the invention there is further provided a filter incorporating a liquid release component, as defined above.

According to the invention there is further provided a flavour release component for a smoking article, the flavour release component formed of a flavour delivery material comprising a closed matrix structure defining a plurality of domains. The closed matrix structure comprises a polymer matrix defining a plurality of domains. The polymer matrix is formed of one or more anionic polysaccharides cross-linked by multivalent cations. The closed matrix structure further comprises a filler within the polymer matrix. The filler comprises one or more amphiphilic polysaccharides. A flavour composition is trapped within the domains of the polymer matrix and is releasable from the closed matrix structure upon compression of the flavour release component.

In the following description, any references to the features or properties of the liquid release component, flavour release component, sustained-release liquid delivery material or flavour delivery material according to the invention also apply to the liquid release component, flavour release component, liquid delivery material or flavour delivery material of filters or smoking articles according to the invention, unless stated otherwise.

Smoking articles according to the present invention incorporating the liquid release component may be filter cigarettes or other smoking articles in which tobacco material or another combustible material is combusted to form smoke. Alternatively, smoking articles according to the present invention may be articles in which an aerosol forming substrate, such as tobacco, is heated to form an aerosol, rather than combusted. In one type of heated smoking article, tobacco material or another aerosol forming material is heated by one or more electrical heating elements to produce an aerosol. In another type of heated smoking article, an aerosol is produced by the transfer of heat from a combustible or heat source to an aerosol forming substrate. The present invention further encompasses smoking articles in which a nicotine-containing aerosol is generated from a tobacco material, tobacco extract or other nicotine source, without combustion, and in some cases without heating, for example through a chemical reaction.

Smoking articles according to the invention may be whole, assembled smoking devices or components of smoking devices that are combined with one or more other components in order to provide an assembled device for producing an aerosol, such as for example, the consumable part of a heated smoking device.

As used herein, the term "smoke" is used to describe smoke produced by combustible smoking articles, such as filter cigarettes, and aerosols produced by non-combustible smoking articles, such as heated or non-heated smoking articles of the types described above.

The term "liquid release component" is used throughout the present specification to refer to a discrete piece or portion of a liquid delivery material which is in a form that is suitable to be incorporated into a smoking article. The liquid release component is preferably in the form of a bead, as described below, but alternative forms such as, for example, a thread or flake, may be suitable in certain embodiments. In preferred embodiments, the liquid release component is a flavour release component for providing flavour in a smoking article.

As used herein, the term "liquid" refers to compositions that are in a liquid state at room temperature (22° C.).

The term "liquid composition" refers to any liquid agent that can be incorporated into a component of an aerosol generating device in order to provide an effect on the aerosol or smoke generated during smoking. The liquid composition may be, for example, a substance that is capable of reducing one or more constituents of the aerosol. Alternatively, the liquid composition may be a substance that is capable of reacting with one or more other substances in the aerosol generating device to produce an aerosol. In preferred embodiments of the invention, the liquid composition is a liquid flavour composition and the liquid delivery material is adapted for providing flavour in a smoking article or a portion of a smoking article.

In the present specification, the expression "starch or starch derivative chemically modified to be amphiphilic" is used to describe a starch or starch derivative which has been treated or reacted with a compound containing hydrophobic groups such as to impart to the starch or starch derivative an amphiphilic nature. Suitable compounds for treating or reacting with starch or starch derivatives shall be known to the skilled person. By way of example, one preferred suitable compound is octenyl succinic anhydride (OSA). Due to the hydrophobic and steric properties of OSA, OSA-modified starch displays a highly branched macromolecular structure, which, without wishing to be bound to theory, is understood to lead to desirable stabilising, interfacial and rheological properties.

In the following description, the invention will be described with reference to a flavour release component formed of a flavour delivery material that provides sustained release of a flavour composition. However, the teaching can also be applied to a material for the sustained released of an alternative liquid composition.

The term "sustained release" is used to indicate that the flavour delivery material is capable of releasing the flavour composition over a range of applied compressive force, over a range of deformation of the material, or both. For example, if the release of the flavour composition as a function of the applied compressive force is measured, it will be seen that the material is capable of releasing the flavour composition at a force of x Newtons and will continue to release progressively more of the flavour composition as the force is increased from x Newtons to (x+y) Newtons (for example, where y is 5 Newtons).

Because they are ranges, the ranges of force and deformation described herein have a width and they extend between the ends of the ranges. For example, using the generic example above where y is 5 Newtons, the range of force would have a width of 5 Newtons and it would extend from x Newtons to (x+5) Newtons.

Since increasing the compressive force over the range of force will release further flavour composition from the flavour delivery material, the term "sustained release" can also be described as "progressive release". This is in contrast to prior art flavour release mechanisms for smoking articles in which flavour is released at a particular force, but flavour is not released prior to or after the particular force. For example, the sustained release flavour delivery profile provided by the flavour release component of the invention is in contrast to the flavour delivery profile of a capsule. Capsules are typically manufactured such that the outer shell of the capsule will break at a specific, defined compressive force. At that specific force, the outer shell will be crushed and substantially all of the flavourant contained within the core of the capsule will be released at the same time. However, at applied forces below that specific force, substantially no flavour will be released.

The sustained release properties of the flavour release component of the smoking articles of the present invention will be described in more detail below.

The flavour release component of the smoking articles of the present invention retains the flavour composition within the structure of the material until a compressive force is applied to the component. To achieve such retention of the flavour composition, the flavour delivery material comprises a closed matrix or network structure, which traps the flavour composition within the closed structure. That is, the flavour composition is trapped in domains within a matrix structure. Upon compression of the material, the flavour composition is forced out from the matrix structure, for example, through the breakage of the surrounding structure.

The closed matrix structure of the flavour delivery material comprises a three-dimensional structural polymer matrix that forms a network defining the plurality of domains. The term "domain" is used throughout the present specification to refer to the closed pores or pockets that contain the flavour composition or the distinct regions or, for certain manufacturing processes for matrix materials, droplets of the flavour composition that are dispersed within the precursor materials of the polymer matrix, as further described below. The flavour composition is dispersed through the polymer matrix in a plurality of discrete domains which are surrounded and enclosed by the polymer matrix.

The polymer matrix of the flavour delivery material isolates the flavour composition so that the flavourant is substantially retained within the structure of the polymer matrix until the flavour delivery material is compressed. Compression of the flavour delivery material results in deformation of the polymer matrix. As the level of applied force, deformation, or both force and deformation increases, the matrix is gradually broken down and the domains begin to rupture, such that the flavour composition retained within the domains is released.

In the flavour release component of the present invention, the polymer matrix of the flavour delivery material is formed of one or more anionic polysaccharides cross-linked by multivalent cations. The cross-linking of the polymer matrix is achieved through reaction of the anionic polysaccharides with multivalent cations which form salt bridges to cross-link the polysaccharides.

The term "anionic polysaccharide" is used throughout the present specification to refer to a polysaccharide having a net negative charge.

In relation to the present invention, the term "multivalent cation" is used to describe a positively charged ion having a valence greater than 1, for example, bivalent or trivalent cations. The multivalent cations are preferably provided in the form of a solution of a multivalent metal salt, such as a solution of a metal chloride. Preferred multivalent cations include calcium, iron, aluminium, manganese, copper, zinc or lanthanum. A particularly preferred cation is bivalent calcium ($Ca^{2+}$).

Polysaccharides are particularly suitable for use in the present invention, since they can be made water insoluble and heat stable through cross-linking, and are tasteless. The cross-linking of the one or more anionic polysaccharides forming the matrix provides structural strength and stability which improves the resistance of the polymer matrix to heat and shear forces to which the material may be subjected during manufacture or processing of the smoking articles incorporating the material. The closed matrix structure also provides effective trapping of the flavour composition with the flavour delivery material. Preferably, the polymer matrix is water or moisture resistant.

The closed matrix structure of the flavour delivery material of the present invention further comprises a filler within the polymer matrix, wherein the filler comprises one or more amphiphilic polysaccharides. The term "amphiphilic polysaccharide" is used throughout the present specification to refer to a polysaccharide having a hydrophilic portion and a hydrophobic portion. In the flavour delivery material of the present invention, the one or more amphiphilic polysaccharides are incorporated within the polymer matrix but have minimal or no ability to cross-link with themselves or the one or more anionic polysaccharides forming the polymer matrix.

The use of a filler comprising one or more amphiphilic polysaccharides provides the flavour delivery material of the present invention with a number of advantageous properties. The amphiphilic polysaccharide within the closed matrix structure is advantageously capable of functioning as both a filler and an emulsification agent. This means that a separate emulsification agent is not necessary and a larger proportion of other functional components can be incorporated within the matrix structure.

In its function as a filler, the amphiphilic polysaccharide increases the dry matter content within the closed matrix structure. Without being bound to theory, the introduction of a filler such as starch acts as a drying retardant, in that it absorbs water and makes evaporation difficult. Thus, it allows for a better control of the sphericity of the shape during the drying step. Fast drying increases evaporation and could lead to the collapse of the matrix. The amphiphilic polysaccharide may also slow down the process of cross-linking, which can improve the sphericity and also provide a tougher outer shell with a relatively soft inner portion, as further discussed below.

The amphiphilic polysaccharide is capable of acting as an effective emulsification agent due to its amphiphilic structure, which includes a hydrophilic portion that can interact with a hydrophilic phase of an emulsion and a hydrophobic portion that can interact with a hydrophobic or lipophilic phase of an emulsion. As described in more detail below, during production of the flavour delivery material of the present invention, an emulsion is typically formed having a hydrophilic phase comprising a solution of the anionic polysaccharides and a lipophilic phase comprising an oil-based solution of a flavour compound. The inclusion of the amphiphilic polysaccharide during production helps to form a more stable emulsion, with a more even composition. As a result, the flavour composition is more effectively captured within the polymer matrix structure and the resultant flavour delivery material is therefore also more stable. The improved stability of the flavour delivery material ensures that the flavourant is effectively retained within the structure during storage of the material.

It has further been found that the inclusion of the filler within the polymer matrix affects the structure of the flavour delivery material. In the flavour delivery material of the present invention, the structure of the polymer matrix varies from the outside of the material towards the centre. In particular, the flavour delivery material comprises a polymer rich outer region, which has a relatively high proportion of the cross-linked polymer matrix, and a flavourant rich core region, which has a relatively high proportion of the flavourant. This structure arises due to the interaction of the hydrophilic solution of anionic polysaccharides with the hydrophobic flavour composition, which will tend to cause the hydrophobic flavour composition to aggregate within a core region upon the formation of a drop of the emulsion of the two components.

As described in more detail below, the cross-linking of the anionic polysaccharides occurs when an emulsion of the flavour composition within a solution of the anionic polysaccharides is dropped into a multivalent cation cross-linking solution. As described above, there is preferably a greater degree of cross-linking in the polymer rich outer region than in the flavourant rich core region. This is reflected by a gradient in the concentration of multivalent cations within the closed matrix structure, wherein the concentration of multivalent cations is highest in the outer region of the flavour release component where the degree of cross-linking is highest and decreases towards the inner, core region of the flavour release component as the proportion of polymer matrix decreases.

The greater degree of cross-linking in the polymer rich outer region of the flavour delivery material increases the hardness of the polymer matrix. The outer region of the flavour release component is therefore harder and has a lower concentration of the flavour composition than the core region.

The inclusion of the filler within the polymer matrix has been found to result in an enhanced gradient in the concentration of multivalent cations between the outer region of the flavour release component and the core region. As described below, it is thought that the amphiphilic polysaccharide of the filler prevents the complete equalisation of the concentration of the multivalent cations from the outer surface through the emulsion so that a greater degree of cross-linking occurs in the outer region compared to the core region. This increases the hardness of the outer region whilst decreasing the hardness of the core region, which in turn provides a further improvement in the retention of the flavour composition within the core region.

Furthermore, the increased level of cross-linking in the polymer matrix within the outer region of the flavour release component provides a harder 'layer' around the outside of the material that is relatively brittle and can crackle or crunch upon initial compression of the material, prior to the release of the flavour composition. This means that upon application of a compressive force to the material by the consumer, the force will initially cause the break down of the polymer matrix in the more brittle outer region before the material is compressed to a sufficient extent to release the flavour composition. The crackling of the polymer rich outer region as it is broken down may be felt by the consumer and may also produce an audible sound. The consumer is therefore advantageously provided with a sensory indication of the activation of the flavour delivery material to release flavour into the smoking article.

The decrease in the degree of cross-linking in the polymer matrix moving away from the outer surface of the flavour release component towards the centre provides a softer inner region beneath the harder outer region. This means that there is less support beneath the outer region, which may advantageously make it easier for the polymer matrix within the outer region to be broken down upon compression of the flavour release element and may additionally enhance any crackling effect provided upon compression. Furthermore, by increasing the softness of the flavour delivery material in the inner region, the flavour delivery material becomes more easily compressed once the harder outer region has been broken down, thereby facilitating the release of the flavour composition upon sustained compression of the flavour release component.

The increased hardness of the outer region of the flavour release component additionally improves the resistance of the flavour release component to undesired deformation, which facilitates the processing of the component. Where the flavour delivery material is in the form of a bead formed from a droplet of emulsion as described below, the slowing of the diffusion of the multivalent cations through the droplet has also been found to improve the roundness of the resultant bead. This further facilitates the processing of the flavour delivery material, in particular, improving the level of precision that is possible in the insertion of beads of the material into smoking articles.

Preferably, the gradient in the concentration of multivalent cations within the closed matrix structure of the flavour release component is such that along a line extending through the liquid release component from the outer surface of the closed matrix structure to the centre of mass of the liquid release component, the highest concentration of multivalent cations within 250 microns from the outer surface of the closed matrix structure is at least about 1.5 times the highest concentration of multivalent cations within 500 microns from the centre of mass.

Preferably, along the line extending through the liquid release component from the outer surface of the closed matrix structure to the centre of mass of the liquid release component, the highest concentration of multivalent cations within 250 microns from the outer surface of the closed matrix structure is at least about 1.75 times and more preferably at least about twice the highest concentration of multivalent cations within 500 microns from the centre of mass.

Further, the flavour release component preferably has a minimum dimension between the outer surface of the closed matrix structure and the centre of mass of the liquid release component that is at least 1.5 mm, more preferably at least 2.0 mm.

Preferably, the gradient in the concentration of multivalent cations within the closed matrix structure of the flavour release component is such that along a line extending through the liquid release component from the outer surface of the closed matrix structure to the centre of mass of the liquid release component, the highest concentration of multivalent cations within 250 microns from the outer surface of the closed matrix structure is at least about 1.5 times the highest concentration of multivalent cations within 250 microns from the centre of mass.

Preferably, along the line extending through the liquid release component from the outer surface of the closed matrix structure to the centre of mass of the liquid release component, the highest concentration of multivalent cations within 250 microns from the outer surface of the closed matrix structure is at least about 1.75 times and more preferably at least about twice the highest concentration of multivalent cations within 250 microns from the centre of mass.

Further, the flavour release component preferably has a minimum dimension between the outer surface of the closed matrix structure and the centre of mass of the liquid release component that is at least 1.5 mm, more preferably at least 2.0 mm.

For the purposes of the present invention, the gradient in the concentration of multivalent cations within the flavour delivery material forming the flavour release component is quantified by measuring the concentration along a line extending through the flavour release component from the outer surface of the closed matrix structure to the centre of mass of the flavour release component. The measurements may be taken by extracting a sample or core from the granule which extends from the outer surface through the centre of mass and forming a plurality of sections by making transverse cuts at a number of positions along the sample or core. Here the term "transverse cuts" is used to mean that the sections are formed by cutting into the sample or core transversely to a longitudinal axis of the sample or core, that is transversely to the line extending through the flavour release component from the outer surface of the closed matrix structure to the centre of mass of the flavour release component. For each section, the concentration of multivalent ions may be measured using a mass spectrometry technique. Any coating layers provided around the flavour delivery material should be disregarded so that measurement of the calcium gradient begins at the outer surface of the closed matrix structure.

By measuring the calcium concentration in a plurality of sections along the core, the highest concentration within 250 microns from the outer surface of the closed matrix material and the highest concentration within 500 microns from the centre of mass of the liquid delivery material may identified. Other suitable techniques for measuring the gradient in the concentration of multivalent cations will also be known to the skilled person. In certain cases, the removal of a sample from the liquid delivery component may be facilitated by freezing the component.

In preferred embodiments of the present invention, the one or more amphiphilic polymers of the filler include modified starch or starch derivatives. A particularly preferred form of modified starch for use in the present invention is octenyl succinic anhydride (OSA) starch. Suitable starch derivatives include but are not limited to maltodextrin, high amylase food starch and combinations thereof.

The closed matrix structure may comprise at least about 10 percent by weight, more preferably at least about 15 percent by weight of the amphiphilic polysaccharides, based on the total dry weight of the closed matrix structure. Alternatively or in addition the closed matrix structure may comprise less than about 30 percent by weight, more preferably less than about 25 percent by weight of the amphiphilic polysaccharides, based on the total dry weight of the closed matrix structure. Preferably, the closed matrix structure comprises between about 10 percent and about 30 percent by weight, more preferably between about 15 percent and about 25 percent by weight of the amphiphilic polysaccharides based on the total dry weight of the closed matrix structure. In the present specification, any reference to the total dry weight of the closed matrix structure excludes the weight of the liquid composition contained within the domains of the closed matrix structure.

Preferably, the amount of anionic polysaccharide in the closed matrix structure is greater than the amount of amphiphilic polysaccharide in the closed matrix structure. For example, the amount of anionic polysaccharide in the closed matrix structure is preferably at least about two times and more preferably at least about three times greater than the amount of amphiphilic polysaccharide in the closed matrix structure.

The polymer matrix may be formed of a single cross-linked anionic polysaccharide. For example, in one preferred embodiment, the polymer matrix is formed of cross-linked alginate. Alternatively, the polymer matrix may be formed of a combination of two or more cross-linked anionic polysaccharides, wherein the two or more anionic polysaccharides are capable of cross-linking with one another. For example, in some embodiments, the polymer matrix comprises alginate and pectin, wherein the alginate and pectin are cross-linked with each other. In some embodiments, the polymer matrix comprises at least about 20 percent by weight pectin. Further, the polymer matrix may have at least about 50 percent by weight alginate. A preferred form of pectin is low methoxy pectin.

Preferably, the polymer matrix comprises alginate, wherein the alginate may be used alone or in combination with one or more other polysaccharides. Alginate is particularly effective for use in the polymer matrix since it cross-links at a high rate and has a structure that interacts well with the multivalent cations that form the salt bridges to cross-link the alginate. In particular, the alginate structure includes blocks of guluronic acid (G) residues that interact strongly with the multivalent cations.

Where the polymer matrix comprises alginate, the proportion of guluronic acid (G) residues in the alginate structure is preferably at least about 25 percent, more preferably at least about 30 percent and most preferably about 35 percent. In some embodiments, the remainder of the structure consists essentially of mannuronic acid (M) residues. Alternatively or in addition, the proportion of guluronic acid (G) residues in the alginate structure is preferably less than about 70 percent, more preferably less than about 65 percent. In some embodiments, the remainder of the structure consists essentially of mannuronic acid (M) residues. The ratio of G:M residues in the alginate structure has been found to affect the cross-linking properties of the alginate and can be adjusted in order to control the cross-linking process. In particular, an increased G:M ratio appears to provide a stereochemistry that favours the cross-linking of the alginate by the multivalent cations.

The closed matrix structure may comprise at least about 50 percent by weight, more preferably at least about 60 percent by weight of the one or more polysaccharides, based on the total dry weight of the closed matrix structure. Alternatively or in addition the closed matrix structure may comprise less than about 90 percent by weight, more preferably less than about 80 percent by weight of the one or more polysaccharides, based on the total dry weight of the closed matrix structure. Preferably, the closed matrix structure comprises between about 50 percent and about 90 percent by weight, more preferably between about 60 percent and about 80 percent by weight of the one or more polysaccharides based on the total dry weight of the closed matrix structure.

In preferred embodiments of the present invention, the closed matrix structure of the flavour delivery material further comprises a plasticiser.

The term "plasticiser" refers to a substance or material incorporated in the matrix forming material to increase its flexibility or workability. Many plasticisers tend to decrease the intermolecular forces between polymer chains, resulting in the increased flexibility and compressibility, or they may exert a plasticising effect because they cause discontinuities in a polymer matrix. Examples of classes of plasticisers are saccharides (mono-, di- or oligo-saccharides), alcohols, polyols, acid salts, lipids and derivatives (such as fatty acids, monoglycerides, esters, phospholipids) and surfactants. Specific examples of suitable plasticisers include but are not limited to: glucose, fructose, honey, sorbitol, polyethylene glycol, glycerol, propylene glycol, lactitol, sodium lactate, hydrated hydrolyzed starches, trehalose, or combinations thereof. Other suitable plasticisers for use in the present invention could be identified by the skilled person based on the examples provided.

The closed matrix structure of the flavour delivery material of the present invention may include a single plasticiser, or a combination or two or more plasticisers.

In the flavour delivery material of the smoking articles of the present invention, the plasticiser may be incorporated into the closed matrix structure in order to soften the polymer matrix such that the material is more compressible. This enables the flavour delivery material to more effectively provide a sustained-release flavour delivery profile. In particular, the plasticiser may increase the range of force over which a sustained delivery of the flavour composition can be provided or decrease the amount of force required to begin releasing the flavour composition.

The closed matrix structure may comprise at least about 5 percent by weight, more preferably at least 10 percent by weight of the plasticiser, based on the total dry weight of the closed matrix structure. Alternatively or in addition, the closed matrix structure may comprise less than about 30 percent by weight, preferably less than about 25 percent by weight, based on the total dry weight of the closed matrix structure. Preferably, the polymer matrix comprises between about 10 percent and about 30 percent by weight, more preferably between about 15 percent and about 25 percent by weight of the plasticiser, based on the total dry weight of the closed matrix structure.

The flavour delivery material preferably comprises at least about 4 percent by weight, and preferably at least about 6 percent by weight of the closed matrix structure materials described above, based on dry weight of the flavour delivery material. Alternatively or in addition, the flavour delivery material preferably comprises less than about 15 percent by weight, more preferably less than about 10 percent by weight of the closed matrix structure materials described above. Preferably, the flavour delivery material comprises between about 4 percent and about 15 percent by weight, more preferably between about 4 percent and about 10 percent by weight and most preferably between about 6 percent and about 10 percent by weight of the closed matrix structure materials described herein.

In the present specification, any reference to the total dry weight of the flavour delivery material refers to the sum of the weight of the closed matrix structure and the weight of the flavour composition after the flavour delivery material has been conditioned in a 22 degrees Celsius, 60% relative humidity condition for one week.

The flavour delivery material preferably comprises at least about 60 percent by weight, and preferably at least about 75 percent by weight of the flavour composition, based on dry weight of the flavour delivery material. Alternatively or in addition, the flavour delivery material preferably comprises less than about 95 percent, more preferably less than about 90 percent by weight of the flavour composition. Preferably, the flavour delivery material comprises between about 60 percent and about 95 percent by weight, more preferably between about 75 percent and about 90 percent by weight of the flavour composition.

The flavour composition of the flavour delivery material incorporated into the smoking articles of the present invention preferably includes a flavourant mixed with one or more fats. It is particularly preferred that the one or more fats are liquid at room temperature (22° C.), or have a melting point below 22 degrees Celsius. For the purposes of the present invention, the "melting point" of a fat is measured using differential scanning calorimetry (DSC).

The one or more liquid fats act as a carrier for the flavourant and can be referred to as an "excipient". The flavourant is blended with the excipient to form the flavour composition. In certain embodiments, the flavourant is dispersed or dissolved in the excipient.

The use of an excipient for the flavourant that is liquid at room temperature is particularly advantageous, since the flavour composition can more readily be released from the flavour delivery material upon compression. Furthermore, with a liquid excipient, the flavourants will typically be more available to the surrounding environment after the release of the flavour composition from the material. This is because the volatile flavour compounds can be more readily releasable from liquid carriers than solid carriers.

In addition, the use of a liquid excipient advantageously improves the dispersion of the flavour composition within the filter material after the flavour composition has been released from the flavour delivery material. For example, where the filter is formed of a fibrous filtration material, the flavour composition will more readily spread through the fibres such that a greater surface area of the filtration material is covered by the flavour composition. This in turn improves the level of contact between the smoke and the flavour composition as the smoke is drawn through the filter such that the transfer of the flavourant into the smoke is enhanced. Preferably, the one or more liquid fats of the flavour composition have a neutral odour and taste. The fats therefore have a minimal impact of the flavour provided by the flavourant mixed with the fats.

Preferably, the liquid fat in the flavour composition includes at least about 30 percent by weight, preferably at least about 50 percent by weight, more preferably at least about 75 percent by weight, and most preferably about 100 percent by weight triglycerides having one or more carboxylic acids with a chain length between 6 and 12. Alternatively, the liquid fat includes at least about 30 percent by weight, preferably at least about 50 percent by weight, more preferably at least about 75 percent by weight, and most preferably about 100 percent by weight triglycerides having all three carboxylic acid chain lengths between 6 and 12.

Particularly preferably, the liquid fat in the flavour composition includes at least about 30 percent by weight, preferably at least about 50 percent by weight, more preferably at least about 75 percent by weight, and most preferably about 100 percent by weight triglycerides having one or more carboxylic acids with a chain length between 8 and 10. Alternatively, the liquid fat includes at least about 30 percent by weight, preferably at least about 50 percent by weight, more preferably at least about 75 percent by weight, and most preferably about 100 percent by weight triglycerides having all three carboxylic acid chain lengths between 8 and 10.

A triglyceride is an ester derived from glycerol and three fatty acids, or carboxylic acids. The "chain length" of a carboxylic acid chain in a triglyceride refers to the number of carbon atoms in the backbone of the carboxylic acid. For example, a carboxylic acid chain length of 12 is formed from glycerol and a fatty acid having 12 carbon atoms in the backbone of the aliphatic tail of the fatty acid. Triglycerides having one or more carboxylic acid chain lengths of between 6 and 12 are typically referred to as medium chain triglycerides (MCTs).

Medium chain triglycerides are particularly suitable for use in the flavour delivery material of smoking articles of the present invention since they are in a stable liquid form at room temperature (22° C.). Furthermore, MCTs provide a neutral odour and taste, which will have a negligible effect on the flavour provided by the flavour composition during smoking. In addition, at a chain length of between 6 and 12, there is advantageously found to be a minimal transfer of the fat components into the smoke.

In particularly preferred embodiments of the invention, the flavour composition comprises a flavourant mixed with MCT oil, for example caprylic/capric triglyceride from fractionated coconut oil. An example of a suitable MCT oil is the commercially available MIGLYOL® 810.

The one or more triglycerides may be provided as individual components, or may be provided in a material including one or more medium chain triglycerides in combination with other components.

The carboxylic acid chains of the medium chain triglycerides of the flavour composition may be saturated such that all bonds between the carbon atoms in the chain are single bonds, or at least partially unsaturated such that the chain includes at least one double or triple bond between two carbon atoms in the chain. Preferably, there are more saturated chains in the triglyceride compounds than unsaturated chains. In some cases, the ratio of saturated to unsaturated chains is at least about 1.6, more preferably at least about 1.8 and most preferably at least 2.0. The greater relative amount of saturated chains can make the product more stable over time, in some cases increasing the potential shelf life of the product.

The flavour composition may include a combination of two or more triglycerides having different chain lengths to each other. For example, the flavour composition may comprise an oil or fat including a mixture of medium chain triglycerides, optionally in combination with other short chain (for example, triglycerides win which all of the chain lengths are less than 6) or long chain triglycerides (for example, triglycerides win which all of the chain lengths are longer than 12). The oil or fat including the triglycerides may be of vegetable origin, animal origin, or artificially produced.

The flavourant of the flavour composition includes one or more flavour compounds for providing a desired flavour upon heating of the flavour delivery material. Suitable flavourants for use in the flavour delivery material of the present invention would be well known to the skilled person. Preferably, the flavourant is soluble in the excipient at room temperature, such that the flavour composition is a liquid. The flavourant may include one or more natural flavourants, one or more synthetic flavourants, or a combination of natural and synthetic flavourants.

A variety of flavours could be used in the flavour delivery material of the smoking articles of the present invention. Suitable flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool.

Preferably, the flavourant includes an essential oil, or a mixture of one or more essential oils. An "essential oil" is an oil having the characteristic odour and flavour of the plant from which it is obtained. Suitable essential oils for inclusion in the flavour granules of the present invention include, but are not limited to, peppermint oil and spearmint oil.

In preferred embodiments of the invention, the flavourant comprises menthol, Eugenol, or a combination of menthol and Eugenol. These flavour types are commonly used to provide a refreshing flavour to the smoke of a smoking article. In a particularly preferred embodiment of the invention, the flavour composition comprises menthol dispersed in MCT oil.

The flavour composition may comprise at least about 15 percent by weight, preferably at least about 20 percent by weight and most preferably at least about 25 percent by weight of the flavourant. Alternatively or in addition, the flavour composition may comprise less than about 50 percent by weight, more preferably less than about 40 percent by weight and most preferably less than about 35 percent by weight of the flavourant. Preferably, the flavour composition comprises between about 15 percent and about 50 percent by weight, more preferably between about 20 percent and about 40 percent by weight and most preferably between about 25 percent and about 35 percent by weight of the flavourant.

The flavour composition may comprise at least about 50 percent by weight, more preferably at least about 60 percent by weight and most preferably at least about 65 percent by weight of the excipient comprising one or more liquid fats. Alternatively or in addition, the flavour composition may comprise less than about 85 percent by weight, more preferably less than about 80 percent by weight and most preferably less than about 75 percent by weight of the excipient. Preferably, the flavour composition comprises between about 50 percent and about 85 percent by weight, more preferably between about 60 percent and about 80 percent by weight and most preferably between about 65 percent and about 75 percent by weight.

Overall, the flavour delivery material may comprise at least about 12 percent by weight, preferably at least about 15 percent by weight and more preferably at least about 20 percent by weight of flavourant. Alternatively or in addition, the flavour delivery material may comprise less than about 40 percent by weight, preferably less than about 35 percent by weight and more preferably less than about 30 percent by weight of flavourant. Preferably, the flavour delivery material comprises between about 12 percent by weight and about 40 percent by weight of flavourant, more preferably between about 15 percent by weight and about 35 percent by weight of flavourant, or most preferably between about 20 percent by weight and about 30 percent by weight of flavourant. In particularly preferred embodiments, the flavourant comprises menthol.

Overall, the flavour delivery material preferably comprises at least about 40 percent by weight, and preferably at least about 50 percent by weight of any one or more of the liquid fats described herein. Alternatively or in addition, the flavour delivery material comprises less than about 70 percent by weight, preferably less than about 65 percent by weight and more preferably less than about 60 percent by weight of any one or more of the liquid fats described herein. Preferably, the flavour delivery material comprises between about 40 percent and about 70 percent by weight, more preferably between about 50 percent and about 65 percent by weight and most preferably between about 50 percent and about 60 percent by weight of any one or more of the liquid fats described herein.

As described above, the flavour delivery material of the flavour release component of the present invention provides a sustained-release delivery profile, such that the amount of the flavour composition released upon compression of the flavour release component can be controlled through the adjustment of the compressive force applied by the consumer, for example over a range of at least 5 Newtons. This provides greater flexibility in the amount of flavour composition that can be released and therefore greater control over the intensity of flavour that is provided during smoking.

Those of skill in the art will understand that the term "sustained release" covers those embodiments in which the amount of flavour composition released at a given force depends additionally on the duration of the applied force. For example, in some embodiments, two brief applications of a given force may release the same amount of flavour composition as a single, extended application of the given force. In these embodiments, it is possible to use the sustained release properties of the material to provide multiple "doses" of the flavour composition by repeatedly applying the same or similar force to the flavour release component. In addition, multiple applications of progressively higher forces can also be used, which in some cases can increase the amount of flavour in the multiple "doses" that are released.

When the flavour release component is in place within the smoking article, a compressive force is exerted on the flavour delivery material through the application of a compressive force to the part of the smoking article incorporating the flavour release component. However, unless stated otherwise in the present description, the properties and parameters of the material are defined in relation to the material itself, apart from the smoking article. For example, the references to applied compressive force and deformation relate to the direct compression or deformation of the material when it is outside of a smoking article. In most cases, the material may be tested by cutting out or otherwise removing the material from the smoking article and testing the material directly.

Within the range of compressive force or deformation, the amount of the flavour composition that is released from the material is dependent on the compressive force applied or the deformation. There may be a substantially continuous relationship between the compressive force or deformation and the amount of flavour composition released. In this case, the amount of flavour composition released will increase substantially continuously as the compressive force applied or the deformation of the material increases. Alternatively, the flavour composition may be released in discrete amounts at certain forces within the defined range of compressive force or deformation, for example with some matrix materials described below. In this case, the amount of flavour composition released will increase in a step wise way as the compressive force or the deformation increases.

In relation to the present invention, the flavour composition is considered to be "released" from within the flavour delivery material when the flavour composition is exposed to the environment outside of the flavour delivery material. The flavour composition is considered to be "released" if it has been emitted from the flavour delivery material into surrounding space or material within the smoking article. Additionally, the flavour composition is considered to be "released" if it is still within the flavour delivery material but one or more open passageways for the volatilisation of the flavourants into the surrounding environment are provided such that the flavour composition may gradually migrate out of the domains. For example, a flavour composition within an open cell structure, such as a sponge, is considered to be "released".

The sustained-release profile of the flavour delivery material means that flavour composition is releasable more than once from the material. The application of a compressive force over a range of at least 5 Newtons may release only a portion of the available flavour composition from the material, such that the remainder of the flavour composition remains within the material for subsequent release. This feature of the flavour delivery material provides the consumer with a high level of control over the timing of the delivery of flavour during smoking, as well as the intensity of the flavour. The consumer may choose to release the flavour composition only once during smoking, for example, immediately prior to the final puff. Alternatively, the consumer may choose to release two or more bursts of the flavour composition at different times during smoking.

The sustained-release flavour delivery profile of the flavour delivery material is provided by the gradual breakdown of the polymer matrix with increasing compressive force. For example, within a range of force of at least 5 Newtons, the domains within the flavour delivery material continue to be ruptured as the compressive force increases, such that the flavour composition is released across the range. At a certain level of applied force, the majority of the domains will have been ruptured and an increase in the compressive force about this level will no longer result in the release of further flavour composition.

Typically, when the flavour release component is in place within the smoking article, the compression of the component by the consumer will only initially result in the rupture of a portion of the domains. The remainder of the domains therefore remain closed with the flavour composition trapped inside until a further compressive force is applied. The domain structure is therefore particularly well adapted to provide a flavour delivery material for multiple releases of flavour during smoking.

Preferably, the flavour delivery material provides a sustained release of the flavour composition upon compression of the material over a range of force of at least about 5 Newtons, more preferably at least about 8 Newtons, more preferably at least about 10 Newtons and most preferably at least about 20 Newtons.

Preferably, the flavour delivery material provides a sustained release of the flavour composition upon compression of the material over a range of force from about 10 Newtons to about 15 Newtons. That is, the range of force preferably extends from about 10 Newtons to about 15 Newtons.

Particularly preferably, the flavour delivery material provides a sustained release of the flavour composition over a broader range of force, for example over a range of force from about 5 Newtons to about 50 Newtons. This could also be described as a range extending from about 5 Newtons to about 50 Newtons. More preferably, the flavour delivery material provides a sustained release of flavour composition over a range of force from about 5 Newtons to about 25 Newtons, most preferably from about 5 Newtons to about 20 Newtons.

Preferably, the amount of the flavour composition released upon compression of the flavour release component with a force of about 5 Newtons corresponds to at least about 2 percent by weight and preferably at least about 4 percent by weight of the flavour delivery material prior to any compression. Preferably, the additional amount of the flavour composition that is released upon further compression of the flavour release component with a force of about 10 Newtons (up to a total of 15 Newtons) corresponds to at least 10 percent by weight of the flavour delivery material prior to any compression.

Preferably, the amount of the flavour composition released upon compression of the flavour release component with a force of about 10 Newtons corresponds to at least about 15 percent by weight and more preferably at least about 20 percent by weight of the flavour delivery material prior to any compression. Preferably, the additional amount of the flavour composition that is released upon further compression of the flavour release component with a force of about 15 Newtons (up to a total of 25 Newtons) corresponds to at least 10 percent by weight of the flavour delivery material prior to any compression.

The present invention further provides a smoking article incorporating a sustained-release flavour delivery material comprising a flavour composition that is releasable upon compression of the material over a range of deformation of at least 25 percent deformation. That is, the range of deformation has a width of at least 25 percent deformation. The deformation of the material will typically increase with increasing compressive force. The percent deformation of the material corresponds to the reduction in dimension of the material upon application of a compressive force in the direction in which the compressive force is applied. The flavour delivery material is capable of releasing the flavour composition over a range of deformation, which means that the amount of the flavour composition that is released will increase progressively as the deformation increases within a defined range.

As described above in relation to the sustained release of the flavour composition over a range of force, the amount of flavour composition released may increase substantially continuously with increasing deformation of the material over the defined range. Alternatively, the amount of flavour composition released may increase in a step wise manner over the defined range of deformation.

The flavour release component of the smoking articles of the present invention will have a characteristic flavour release profile. The "flavour release profile" of the flavour release component refers to the way in which the release of the flavour composition from the flavour delivery material varies as a function of the applied compressive force, or the deformation of the material.

It is assumed that most, if not all of the weight loss exhibited upon compression or deformation of the release component is as a result of the release of the flavour composition from the flavour delivery material. The amount of flavour composition released from the material can therefore be determined by measuring the difference in the weight of the flavour delivery material before and after compression and calculating the percentage reduction in the total weight of the flavour delivery material. As defined above, the weight loss is calculated with reference to the initial weight of the flavour delivery material prior to any compression.

The flavour release component as described above may advantageously be incorporated into a wide variety of different types of smoking articles. For example, the flavour release component may be incorporated into combustible smoking articles, such as filter cigarettes, having a rod of tobacco cut filler or other smokable material, which is combusted during smoking.

Alternatively, the flavour release component may be incorporated into heated smoking articles of the type described above in which material is heated to form an aerosol, rather than combusted. For example, the flavour release component may be incorporated into a heated smoking article comprising a combustible heat source, such as that disclosed in WO-A-2009/022232, which comprises a combustible heat source and an aerosol-generating substrate downstream of the combustible heat source. The flavour release component may also be incorporated into heated smoking articles comprising non-combustible heat sources, for example, chemical heat sources or electrical heat sources such as electrical resistive heating elements.

Alternatively, the flavour release component as described above may be incorporated into smoking articles in which a nicotine-containing aerosol is formed from a tobacco material or other nicotine source without combustion and in some cases without heating, such as those described in WO-A-2008/121610 and WO-A-2010/107613.

Smoking articles according to the present invention may incorporate the flavour release component in any one or more of the components of the smoking article. The smoking article component or portion of the component incorporating the flavour delivery material should be deformable, such that a compressive force can be applied to the flavour delivery material through the compression of the component. Preferably, the flavour release component is incorporated into the filter or mouthpiece of the smoking article. The filter or mouthpiece may be compressed in order to apply a compressive force to the flavour delivery material to release the flavour composition into the surrounding filter. During smoking of the smoking article, the flavourant from the portion of the flavour composition that has been released from the flavour delivery material is delivered into the smoke that passes through the filter.

The filter may be a single segment filter, formed of a single segment incorporating the flavour delivery material. Alternatively, the filter may be a multi-component filter comprising at least one filter segment incorporating the flavour release component and at least one additional filter segment. A variety of suitable filter segments would be well known to the skilled person including but not limited to fibrous filter tows, cavity filter segments, tubular filter segments and flow restrictor segments. One or more of the filter segments may comprise an additional flavour material, a sorbent material, or a combination of a flavour material and a sorbent material.

In certain preferred embodiments of the invention, the flavour release component is incorporated within a segment of a fibrous filtration material, such as cellulose acetate tow. In such embodiments, one or more flavour release components are preferably dispersed through the fibrous filtration material during production of the filter segment such that in the assembled filter, the flavour delivery material is embedded within the segment. Upon compression of the filter and the flavour release component within the filter, the flavour composition is released into the surrounding fibrous filtration material. Advantageously, where the flavour composition comprises a liquid excipient, such as one or more liquid fats, the flavour composition is readily dispersed amongst the fibrous filtration material upon release from the flavour delivery material, as described above. The flavour composition thereby coats the fibres of the filtration material to optimise the transfer of the flavourants into the smoke.

In alternative embodiments of the invention, the flavour release component is incorporated within a cavity in the filter. For example, the flavour release component may be incorporated within a cavity between two filter plugs, wherein the cavity is defined by a filter wrapper surrounding the filter.

Preferably, the flavour release component within the filter is visible to the consumer through the one or more layers of wrapping material circumscribing the filter. Suitable arrangements for providing a filter with visibility of the filter material would be known to the skilled person.

As described above, the form of the flavour release component may vary. Suitable forms for incorporation into a smoking article or filter according to the invention include but are not limited to beads, threads, sheets or flakes. Preferably, the flavour release component is in the form of a bead, which is preferably rounded and particularly preferably, substantially cylindrical or spherical.

The width of the flavour release component may be greater than about 1 mm, preferably greater than about 2 mm, and more preferably greater than about 3 mm. Alternatively or in addition, the width of the flavour release component may be less than about 8 mm, preferably less than about 6 mm, and more preferably less than about 4 mm. Preferably, the width of the flavour release component is between about 1 mm and about 8 mm, more preferably between about 2 mm and about 6 mm, even more preferably between about 3 mm and about 4 mm.

The "width" of the flavour release component corresponds to the maximum dimension of the transverse cross section of the flavour release component, wherein the transverse cross section is the largest section created by a plane cutting across the flavour release component when arranged as intended to be incorporated into a smoking article, the plane being substantially perpendicular to the longitudinal axis of the smoking article. For a substantially spherical bead, the width of the bead substantially corresponds to the diameter of the bead.

A single flavour release component may be provided within the smoking article, or a plurality of flavour release component may be provided, for example two or more, three or more, or four or more flavour release components. Where a plurality of flavour release components is provided, the flavour release components may be spaced apart along the smoking article, or may be placed in one or more specific regions of the smoking article, for example within the filter. One or more flavour release components of the flavour delivery material can be inserted into the smoking articles according to the invention using known apparatus and methods for inserting objects into filters or tobacco rods.

The flavour delivery material may be coloured, if desired, through the inclusion of a colourant. Preferably, a colourant is incorporated into the flavour delivery material in order to adjust the colour of the material so that it resembles the colour of the material in the component of the smoking article in which the flavour release component is incorporated. For example, if the flavour release component is incorporated into the tobacco rod of a smoking article, the flavour delivery material may be brown or green in colour. The flavour release component therefore has a low visibility in the tobacco rod.

Smoking articles according to the invention may each include greater than about 1 mg and preferably greater than about 3 mg of any of the flavour delivery materials described herein. Alternatively or in addition, each smoking article may include less than about 20 mg, preferably less than about 12 mg, and more preferably less than about 8 mg of any of the flavour delivery materials described herein. Preferably, each smoking article includes between about 1 mg and about 20 mg, more preferably between about 1 mg and about 12 mg, and most preferably between about 3 and about 8 mg of the flavour delivery material.

Preferably, the overall length of smoking articles according to the present invention is between about 70 mm and about 128 mm, more preferably about 84 mm.

Preferably, the external diameter of smoking articles according to the present invention is between about 5 mm and about 8.5 mm, more preferably between about 5 mm and about 7.1 mm for slim sized smoking articles or between about 7.1 mm and about 8.5 mm for regular sized smoking articles.

Preferably, the overall length of the filters of smoking articles according to the present invention is between about 18 mm and about 36 mm, more preferably about 27 mm.

Smoking articles according to the present invention may be packaged in containers, for example in soft packs or hinge-lid packs, with an inner liner coated with one or more flavourants.

According to the present invention there is also provided a method for producing the flavour delivery material as described above. The method comprises the steps of forming a flavour composition by dispersing any of the flavourants described above in one or more fats that are liquid at room temperature (22° C.); mixing the flavour composition with a matrix solution comprising one or more anionic polysaccharides, a filler comprising one or more amphiphilic polysaccharides and a plasticiser to form an emulsion; and adding the emulsion to a cross-linking solution of multivalent cations to cross-link the anionic polysaccharides to form a polymer matrix including a plurality of domains of the flavour composition.

Preferably, the flavourant is mixed with the one or more fats at room temperature (22° C.) to form a lipophilic flavour composition. Preferably, the flavour composition is then mixed with the matrix solution at room temperature (22° C.) and preferably, the mixing is carried out under high shear, for example in a shear mixer at a shear rate of 100 $s^{-1}$. The mixture is not heated during this step although the temperature of the mixture may rise as a result of the applied shear. Preferably, the temperature does not rise above about 50 degrees Celsius.

Preferably, the matrix solution comprises a hydrophilic solution of the one or more anionic polysaccharides and the one or more amphiphilic polysaccharides in water. Preferably, the matrix solution contains about 5 percent or less by weight of the anionic polysaccharides. Particularly preferably, the matrix solution contains between 2 percent and 5 percent by weight of the anionic polysaccharides. Preferably, the matrix solution contains about 4 percent or less by weight of the amphiphilic polysaccharides. Particularly preferably, the matrix solution contains between 0.5 percent and 4 percent by weight of the amphiphilic polysaccharides. Preferably, the matrix solution additionally comprises about 1 percent or less by weight of a plasticiser, as described above. Particularly preferably, the matrix solution comprises between about 0.1 percent and about 0.8 percent by weight of a plasticiser.

Preferably, the lipophilic flavour composition and the hydrophilic matrix solution are mixed to form an emulsion comprising between about 15 percent and about 35 percent by weight of the flavour composition, more preferably between about 20 percent and about 30 percent by weight of the flavour composition.

During emulsification, the amphiphilic polysaccharides act as an emulsification agent, with the hydrophilic portion of the amphiphilic polysaccharides interacting with the hydrophilic matrix solution and the hydrophobic portion of the amphiphilic polysaccharides interacting with the lipophilic flavour composition.

Preferably the emulsion is contacted with a multivalent cation cross-linking solution at a temperature of about 5 degrees Celsius to about 15 degrees Celsius. Preferably, the cross-linking solution is a solution of approximately 5 percent by weight multivalent cations in water. Particularly preferably, the cross-linking solution is a calcium salt solution, for example, a calcium chloride solution. The emulsion is preferably left in contact with the cross-linking solution for between about 5 minutes and about 15 minutes, more preferably between about 8 minutes and about 12 minutes. The length of time may be selected depending on the desired degree of cross-linking and the desired hardness of the polymer matrix. During the cross-linking step, there is little or no cross-linking of the amphiphilic polysaccharides.

It has been found that during the cross-linking step, the amphiphilic polysaccharide acts to slow down the migration of the multivalent cations from the surface of the emulsion into the interior of the emulsion. This means that a higher level of cross-linking occurs in the outer region of the emulsion, which enhances the gradient in the concentration of calcium ions between the outer region and the core region of the emulsion, as discussed above.

After cross-linking, the resultant flavour delivery material is removed from the cross-linking solution, for example, using a sieve or similar apparatus. The flavour delivery material is then preferably rinsed to remove the cross-linking solution from the surface and dried. Drying may be carried out using any suitable means, including for example a stream of hot air. The drying may optionally be carried out under vacuum.

Prior to being added to the cross-linking solution, the emulsion of the flavour composition and matrix solution may be formed into a variety of shapes, depending upon the desired form of the flavour delivery material. For example, the emulsion may be formed into cylindrical or spherical shapes in order to produce threads, beads or droplets of the material. This may be carried out using a suitable extrusion or spheronisation technique. Alternatively, the emulsion may be formed into a sheet, cut into strips or flakes, or drawn into an elongate filament or yarn.

The invention will be further described, by way of example only, with reference to the accompanying FIGURE in which:

FIG. 1 which shows a side view of a filter cigarette according to the present invention comprising a flavour delivery material in the tobacco rod.

The cigarette 10 shown in FIG. 1 comprises an elongate, cylindrical wrapped tobacco rod 12 attached at one end to an axially aligned, elongate, cylindrical filter 14. The filter 14 includes a single segment of cellulose acetate tow. The wrapped tobacco rod 12 and the filter 14 are joined in a conventional manner by tipping paper 16, which circumscribes the entire length of the filter 14 and an adjacent portion of the wrapped tobacco rod 12. To mix ambient air with mainstream smoke produced during combustion of the wrapped tobacco rod 12, a plurality of annular perforations 18 are provided through the tipping paper 16 at a location along the filter 14.

A single flavour bead 20 formed of a sustained release flavour delivery material, as described above, is provided centrally within the filter 14. The flavour bead 20 has a diameter of around 4 mm. The flavour delivery material in the bead 20 incorporates a flavour composition comprising a menthol flavourant, which is released upon compression of the material with a force of between about 5 Newtons and about 10 Newtons. After compression, the menthol flavourant is available for release into the mainstream smoke as the smoke passes through the filter during smoking.

The amount of flavour composition released from the flavour delivery material depends upon the applied compressive force such that the flavour intensity can be controlled through control of the pressure applied to the filter. The flavour bead can be compressed one or more times prior to or during smoking in order to provide a burst of menthol flavour to the smoke.

An example of a suitable formulation for the flavour delivery material forming the bead and a process for forming the flavour delivery material is set out below.

EXAMPLE 1

The flavour delivery material comprises a cross-linked alginate matrix with a plurality of domains of a menthol flavour composition dispersed through the matrix. To produce the flavour delivery material, the menthol flavour composition is first formed from a mixture of the following components:

| Component | Amount (weight percent) |
|---|---|
| Natural L-menthol | 26.07 |
| MCT Oil (MYGLIOL 810) | 72.05 |
| Other flavour | 1.88 |

The mixing is conducted with magnetic agitation at a temperature of 30 degrees Celsius for a period of 20 minutes.

A matrix solution is then formed from a mixture of the following components:

| Component | Function | Amount (weight percent) |
|---|---|---|
| Sodium alginate (available from Sigma Aldrich) | Anionic polysaccharide | 2.36 |
| OSA-modified corn starch | Amphiphilic polysaccharide filler | 0.67 |
| Glycerol | Plasticiser | 0.34 |
| Sorbitol | Plasticiser | 0.34 |
| Water | Solvent | 96.29 |

As the amphiphilic polysaccharide filler, OSA-modified corn starch HI-CAP™ 100 (commercially available from National Starch & Chemical, Manchester UK) is used. HI-CAP™ 100 is an OSA-modified starch derived from waxy maize. Due to the hydrophobic and steric properties imparted by OSA, HI-CAP™ 100 is structurally significantly different from a natural starch, such as Merizet® 100 starch (commercially available from Tate & Lyle), and displays, accordingly, different chemical-physical properties, including in particular interfacial and rheological properties.

The mixing is conducted with a marine impeller operating at 1500 revolutions per minute and at a temperature of less than 30 degrees Celsius. The mixing is continued for 30 minutes.

A solution then is formed with 30 percent w/w of the flavour composition and 70 percent w/w of the matrix solution. The solution is mixed in a shear mixer, such as a Polytron 3100B, available from Kinematica. The solution is subjected to high shear at an RPM of 15000 to 20000 whilst maintaining the mixture at a temperature of 52-55 degrees Celsius. The mixing is continued for 3 to 4 minutes to produce an emulsion of the flavour composition in the matrix polymer solution in which the size of the flavour composition droplets is reduced to below about 10 to 50 microns.

The emulsion is then added to a cross-linking solution of the following composition to form the polymer matrix having the plurality of domains.

| Component | Amount (weight percent) |
|---|---|
| Calcium chloride (available from Sigma Aldrich) | 5.0 |
| Water | 95.0 |

The emulsion is dripped into a bath of the cross-linking solution to form a flavour delivery material in the form of beads. The emulsion is added drop-by-drop through a nozzle using a peristaltic pump. The emulsion is dropped through a 5 millimetre nozzle at a flow rate of 500 grams per hour. The process is carried out at room temperature and the bath of cross-linking solution is agitated using a magnetic mixer at a speed of 100 revolutions per minute. The emulsion and the cross-linking solution are allowed to react for a period of ten minutes.

The beads are then removed from the cross-linking solution and washed in deionised water before being dried in a stream of dried air at a temperature of about 25 degrees Celsius for at least 360 minutes.

The number average weight of each dry bead of flavour material is 29.1 milligrams and the number average diameter of each bead is 3.94 millimetres. The average water content of each bead is between about 4 percent and about 6 percent by weight and the average menthol content of each bead is approximately 20 to 25 percent by weight.

The gradient in the concentration of calcium cations in the closed matrix structure of one of the beads produced according to the method above was measured using the following method:

A bead was first embedded in Tissue Tek® resin and frozen to a temperature of minus 10 degrees Celsius. A core of the bead having a cross section of 1 mm was taken along a diameter with a Harris uni-core disposable unit. The extracted core from the bead was embedded in Tissue Tek® and frozen again before being transferred on the cold stage of a customised Reichert-Yung Autocut 1150 microtome in which the core was cut perpendicularly at spaced apart intervals of 125 microns to form a plurality of sections. Each section is then transferred within a frozen cylinder of Tissue Tek® to a mass spectrometer for analysis of the concentration of calcium ions within the section.

The highest measured calcium concentration in the sections taken from the outer 250 microns of the core was approximately 1.6 times the highest measured concentration in the sections taken from the portion of the core extending 500 microns from the centre of mass of the bead.

Upon the application of a compressive force to one of the beads, the bead was found to initially crackle as the polymer matrix in the outer region was broken down before beginning to release the flavour composition from within the polymer matrix. An audible indication of the release of the flavour composition was therefore detected. Following the breakdown of the polymer matrix in the outer region the bead was found to provide a sustained release of the flavour composition over a range of force of at least 5 Newtons.

The invention claimed is:

1. A smoking article incorporating at least one liquid release component formed of a sustained-release liquid delivery material comprising:

a closed matrix structure comprising:

a polymer matrix defining a plurality of domains, wherein the polymer matrix is formed of one or more anionic polysaccharides cross-linked by multivalent cations and a filler within the polymer matrix, the filler comprising one or more amphiphilic polysaccharides; and a flavour composition that is trapped within the domains and is releasable from the closed matrix structure upon compression of the liquid release component, wherein the one or more amphiphilic polysaccharides of the filler are selected from starch chemically modified to be amphiphilic and starch derivatives chemically modified to be amphiphilic, and wherein the liquid delivery material comprises between 4 percent by weight and 15 percent by weight of the closed matrix structure and between 60 percent by weight and 90 percent by weight of the flavor composition, based on dry weight.

2. A smoking article according to claim 1 wherein the chemically modified starch includes octenyl succinic anhydride (OSA) starch.

3. A smoking article according to claim 1 wherein the amount of the filler in the closed matrix structure corresponds to between 10 percent and 30 percent by weight of the closed matrix structure, based on dry weight.

4. A smoking article according to claim 1 wherein the closed matrix structure further comprises a plasticiser.

5. A smoking article according to claim 1 wherein the one or more anionic polysaccharides in the polymer matrix include alginate.

6. A smoking article according to claim 5 wherein the alginate comprises at least 35 percent by weight guluronic acid residues.

7. A smoking article according to claim 1 wherein the amount of the anionic polysaccharide in the closed matrix structure is at least twice the amount of the amphiphilic polysaccharide, based on dry weight.

8. A smoking article according to claim 1 wherein the flavour composition comprises a flavourant mixed with one or more fats that are liquid at room temperature (22° C.).

9. A smoking article according to claim 8 wherein the flavour composition comprises menthol.

10. A smoking article according to claim 1 wherein the multivalent cations in the polymer matrix of the liquid delivery material are calcium ions.

11. A smoking article according to claim 1 wherein a concentration of multivalent cations in the closed matrix structure is highest in an outer region of the flavour release component where a degree of cross-linking is highest and decreases towards an inner core region of the flavour release component.

12. A filter for a smoking article incorporating at least one flavour release component formed of a sustained-release flavour delivery material, the sustained-release flavour delivery material comprising:

a closed matrix structure defining a plurality of domains, wherein the closed matrix structure comprises a polymer matrix of one or more anionic polysaccharides cross-linked by multivalent cations and a filler within the polymer matrix, the filler comprising one or more amphiphilic polysaccharides; and a flavour composition that is trapped within the domains and is releasable from the closed matrix structure upon compression of the flavour release component, wherein the one or more amphiphilic polysaccharides of the filler are selected from starch chemically modified to be amphiphilic and starch derivatives chemically modified to be amphiphilic, and wherein the sustained-release flavour delivery material comprises between 4 percent by weight and 15 percent by weight of the closed matrix structure and between 60 percent by weight and 90 percent by weight of the flavor composition, based on dry weight.

13. A filter according to claim 12 wherein the one or more amphiphilic polysaccharides comprises octenyl succinic anhydride (OSA) starch.

14. A filter according to claim 12 wherein the amount of the filler in the closed matrix structure corresponds to between 10 percent and 30 percent by weight of the closed matrix structure, based on dry weight.

15. A filter according to claim 12 wherein the one or more anionic polysaccharides in the polymer matrix include alginate.

16. A flavour release component for a smoking article, wherein the flavour release component is formed of a flavour delivery material comprising:

a closed matrix structure defining a plurality of domains, wherein the closed matrix structure comprises a polymer matrix of one or more anionic polysaccharides cross-linked by multivalent cations and a filler within the polymer matrix, the filler comprising one or more amphiphilic polysaccharides; and a flavour composition that is trapped within the domains and is releasable from the closed matrix structure upon compression of the material, wherein the one or more amphiphilic polysaccharides of the filler are selected from starch chemically modified to be amphiphilic and starch derivatives chemically modified to be amphiphilic, and wherein the flavour delivery material comprises between 4 percent by weight and 15 percent by weight of the closed matrix structure and between 60 percent by weight and 90 percent by weight of the flavor composition, based on dry weight.

17. A flavor release component according to claim 16 wherein the one or more amphiphilic polysaccharides comprises octenyl succinic anhydride (OSA) starch.

18. A flavor release component according to claim 16 wherein the amount of the filler in the closed matrix structure corresponds to between 10 percent and 30 percent by weight of the closed matrix structure, based on dry weight.

19. A flavor release component according to claim 16 wherein the one or more anionic polysaccharides in the polymer matrix include alginate.

* * * * *